US008955656B1

(12) United States Patent
Foster et al.

(10) Patent No.: US 8,955,656 B1
(45) Date of Patent: Feb. 17, 2015

(54) LUGGAGE TABLE

(76) Inventors: Angela Foster, Lakewood, CO (US); Gary Jones, Lakewood, CO (US)

( * ) Notice: Subject to any disclaimer, the term of this patent is extended or adjusted under 35 U.S.C. 154(b) by 563 days.

(21) Appl. No.: 13/284,903

(22) Filed: Oct. 29, 2011

Related U.S. Application Data

(60) Provisional application No. 61/408,279, filed on Oct. 29, 2010.

(51) Int. Cl.
*A45C 13/28* (2006.01)
*A45C 5/03* (2006.01)

(52) U.S. Cl.
USPC ..... 190/11; 108/11; 108/17; 108/19; 108/56.1; 108/50.11

(58) Field of Classification Search
USPC ..... 190/11; 108/43, 82, 48, 11, 17–19, 108/50.11, 56.1
See application file for complete search history.

(56) References Cited

U.S. PATENT DOCUMENTS

| | | | | | |
|---|---|---|---|---|---|
| 151,090 | A * | 5/1874 | Chapman | 108/27 |
| 564,711 | A * | 7/1896 | O'Brien | 108/35 |
| 1,263,122 | A * | 4/1918 | Sandstrom | 108/1 |
| D70,369 | S * | 6/1926 | Johnson | D7/536 |
| 2,673,774 | A * | 3/1954 | Di Prima | 108/36 |
| 2,831,739 | A * | 4/1958 | Fryckholm | 248/188.5 |
| 3,244,125 | A * | 4/1966 | Mackey | 108/25 |
| 3,558,157 | A * | 1/1971 | Neumann | 280/652 |
| 4,311,099 | A * | 1/1982 | Roberts | 108/47 |
| 5,016,156 | A * | 5/1991 | Ogawa | 363/21.12 |
| 5,485,793 | A * | 1/1996 | Crowell | 108/44 |
| 5,535,682 | A * | 7/1996 | Aigeldinger | 108/25 |
| 5,845,585 | A * | 12/1998 | Meeus et al. | 108/44 |
| 6,123,935 | A * | 9/2000 | Wefler et al. | 424/76.1 |
| 6,148,739 | A * | 11/2000 | Martin | 108/50.01 |
| 6,889,618 | B1 * | 5/2005 | Gromack | 108/151 |
| 7,037,858 | B2 * | 5/2006 | Park | 438/763 |
| 7,950,335 | B1 * | 5/2011 | Almond et al. | 108/42 |
| D642,408 | S * | 8/2011 | Pirkl | D6/511 |
| 2004/0262485 | A1 * | 12/2004 | Marceau et al. | 248/346.01 |
| 2006/0049193 | A1 * | 3/2006 | D'Olimpio et al. | 220/6 |
| 2008/0011915 | A1 * | 1/2008 | Landman | 248/150 |

* cited by examiner

*Primary Examiner* — Tri Mai
(74) *Attorney, Agent, or Firm* — Leyendecker & Lemire, LLC

(57) ABSTRACT

A luggage table adapted to couple to a suitcase and provide a conveniently located, relatively stable platform on which to place personal effects, is described. The luggage table typically rests securely on top of the suitcase, with an aperture in the residing in the middle of the luggage table and a suitcase handle protruding therethrough. In some embodiments, the luggage table includes a surface having a relatively high coefficient of friction, in order to reduce the chances of an item stored thereupon from sliding. In some embodiments, the luggage table includes vessel holders adapted to receive beverage containers such as coffee cups, drinking glasses, or beverage bottles.

6 Claims, 11 Drawing Sheets

LUGGAGE TABLE

This application claims priority to and incorporates by reference, U.S. Patent Application No. 61/408,279, filed 29 Oct. 2010. The present application has the same title and inventors as the aforementioned application.

BACKGROUND

Travelers frequently need to use, store, or otherwise tend to personal effects while maintaining possession and control of their luggage at an airport, bus station, or similar transportation terminal. The personal effects can include a portable computer, tablet computer, digital reader, cellular phone, or similar electronic device. Other personal effects include food and beverages.

A traveler will often want to set her personal effects in a convenient location near the traveler's luggage. For instance, the traveler may wish to set her electronic reader or smart phone on a relatively stable horizontal surface proximate her luggage while the traveler reads a screen of the electronic reader. Similarly, a traveler may wish to set her food or beverage on a horizontal surface proximate the traveler's luggage.

Currently, travelers will sometimes set their beverages or food plates on an airport floor because other horizontal surfaces are unavailable or inconveniently located. However, an airport floor is an undesirable surface for numerous reasons. The floor can be very dirty, and thereby present a contamination hazard to food or beverage placed thereupon, and items placed on the floor are vulnerable to being kicked or stepped on.

In some circumstances, a traveler may wish to change locations in an airport without stowing electronic devices or food and drink in her luggage or hand bag. Accordingly, the traveler can have difficulty carrying personal effects while simultaneously walking, pushing or pulling wheeled luggage, and carrying a purse, carry-on bag, or similar accoutrement.

DETAILED DESCRIPTION

Figure 1:
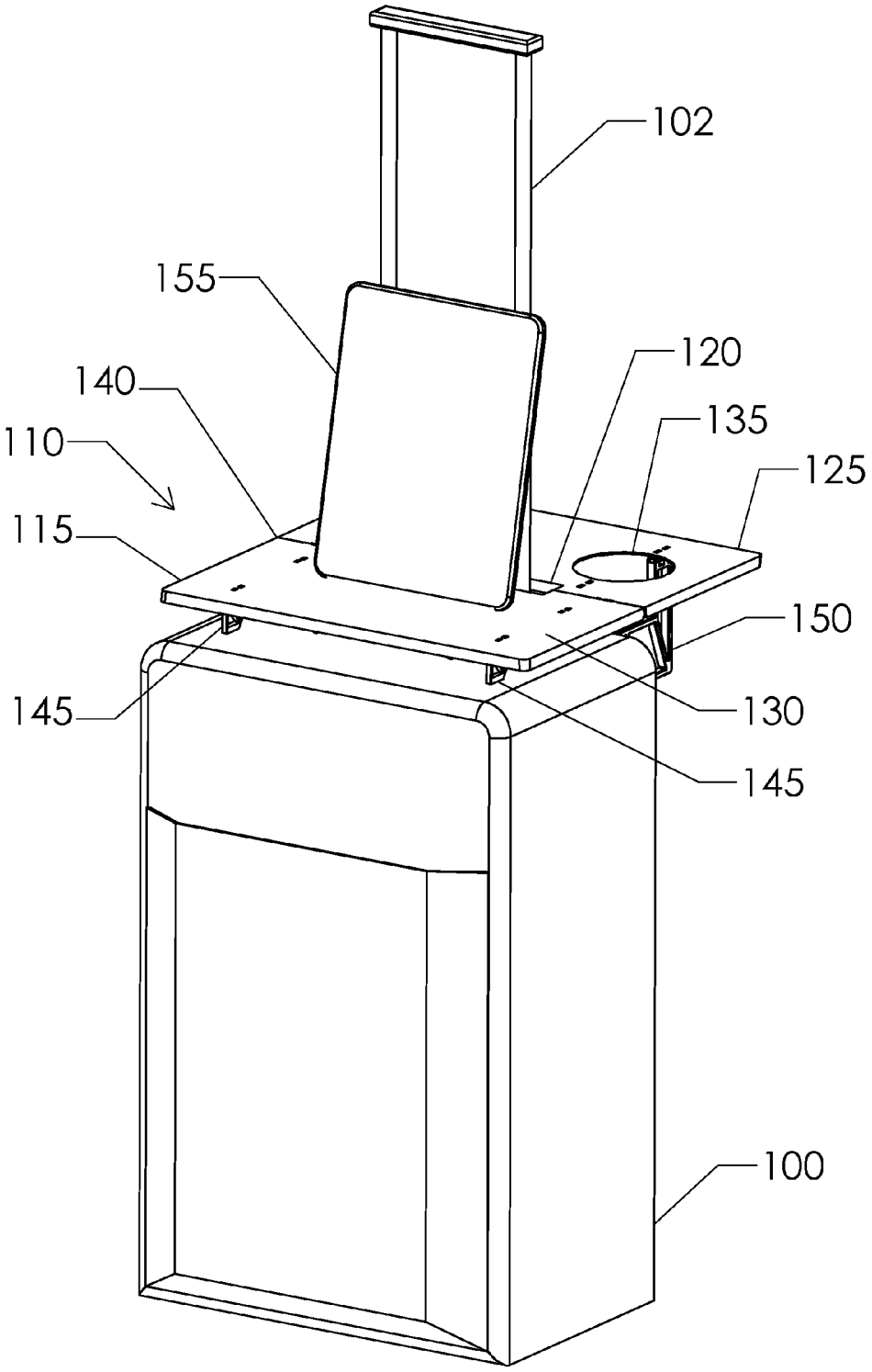
FIG. 1 is a perspective view of a luggage table mounted on a suitcase according to one embodiment of the present invention.

Embodiments of the present invention comprise a luggage table adapted to install on a suitcase and provide a conveniently located, relatively stable platform on which to place personal effects. Typically, the luggage table rests securely on top of the suitcase, and includes an aperture through which an extendable suitcase handle protrudes. In some embodiments, the luggage table includes a non-skid friction strip or pad comprising material having a relatively high coefficient of friction, in order to reduce the chances of an item stored thereupon from sliding. The high coefficient of friction material can help keep an electronic device or other item in a particular orientation on the luggage table, and can also help prevent items from sliding off the luggage table entirely. In some embodiments, the luggage table includes vessel holders adapted to receive beverage containers such as coffee cups, drinking glasses, or beverage bottles.

TERMINOLOGY

The terms and phrases as indicated in quotation marks (" ") in this section are intended to have the meaning ascribed to them in this Terminology section applied throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given. A line or plane is approximately horizontal or vertical when the line or plane is plus or minus 9° of horizontal or vertical, respectively. Lines or planes that are approximately perpendicular are plus or minus 9° of being perpendicular.

The term "about," as used in this specification and appended claims, refers to plus or minus 20% of the value given. A line or plane is about horizontal or vertical when the line or plane is plus or minus 18° of horizontal or vertical, respectively. Lines or planes that are about perpendicular are plus or minus 18° of being perpendicular.

The terms "generally" and "substantially," as used in this specification and appended claims, mean mostly, or for the most part.

Directional or relational terms such as "top," "bottom," "upwardly," "downwardly," "above," "below," "inside," "outside," "upper," "lower," and "horizontal," as used in this specification and appended claims, refer to relative positions of identified elements, components or objects, when the luggage table is oriented as normally used, mounted on a piece of luggage with the luggage standing about upright with the handle extending about vertically from a top surface of the upright luggage.

The terms "print," "printed," "printing," and similar terms, refers to graphics, images, or indicia made visible on a luggage table through technologies including, but not limited to, painting, embossing, laser printing, inkjet printing, ink or dye sublimation, and application of decals, display films, or other films.

The terms "removable," "removably coupled," "readily removable," "readily detachable," and similar terms, as used in this specification and appended claims, refer to structures that can be uncoupled from an adjoining structure with relative ease (i.e., non-destructively and without a complicated or time-consuming process) and that can also be readily reattached or coupled to the previously adjoining structure.

The term "longest dimension," as used in this specification and appended claims, refers to a distance between two points residing on a periphery of the luggage table, where the two points are farthest apart of any two points on the luggage table periphery.

The terms "thick," "thickness," and "maximum thickness," as used in this specification and appended claims, refer to measurement of the luggage table across its smallest dimension. For the purposes of determining "thickness," a luggage table is treated as a three dimensional solid, having a length, a width, and a thickness.

A First Embodiment Luggage Table

Figure 2:
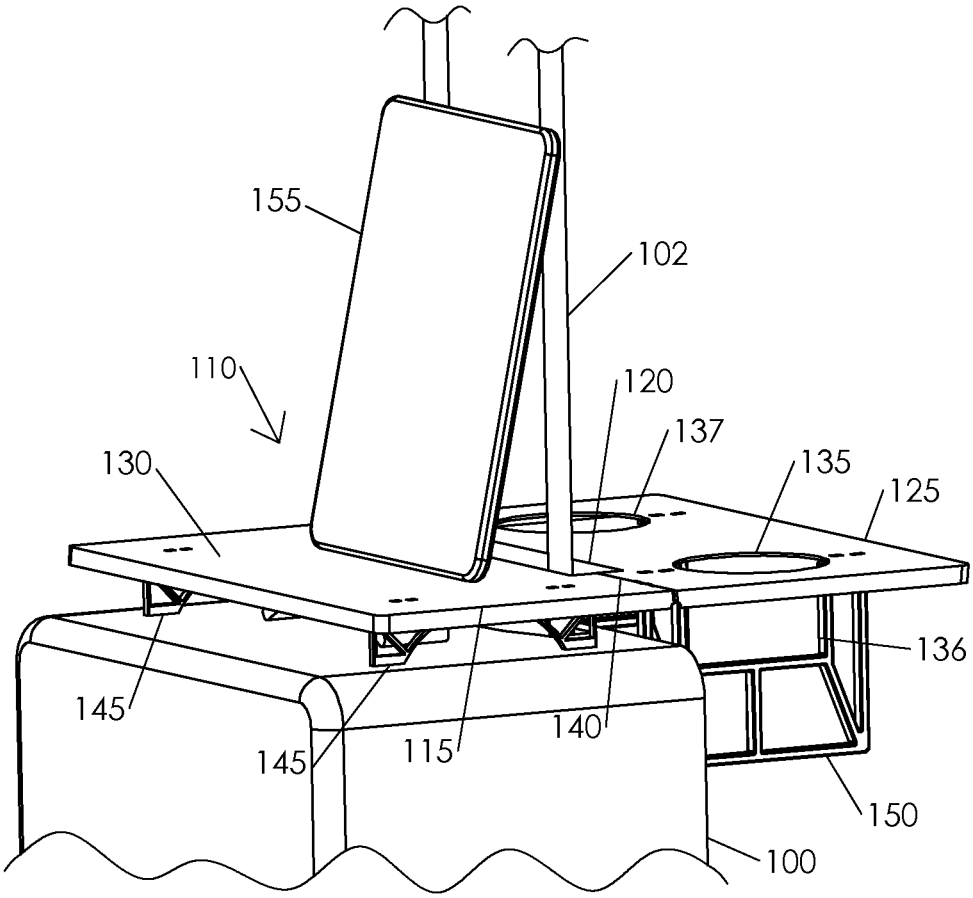
FIG. 2 is a perspective view of a luggage table mounted on a suitcase according to one embodiment of the present invention.
Figure 3:
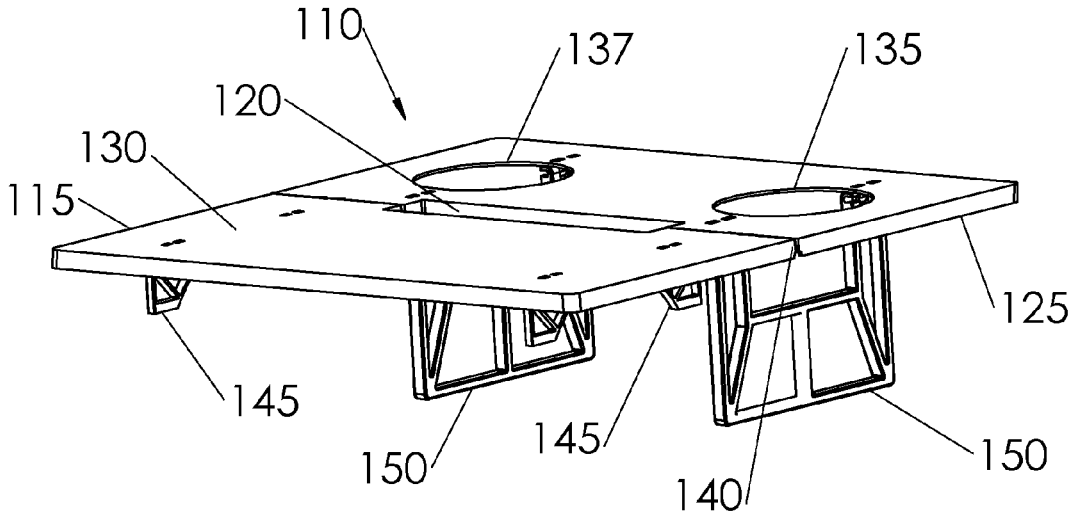
FIG. 3 is a perspective view of a luggage table according to one embodiment of the present invention.
Figure 4:
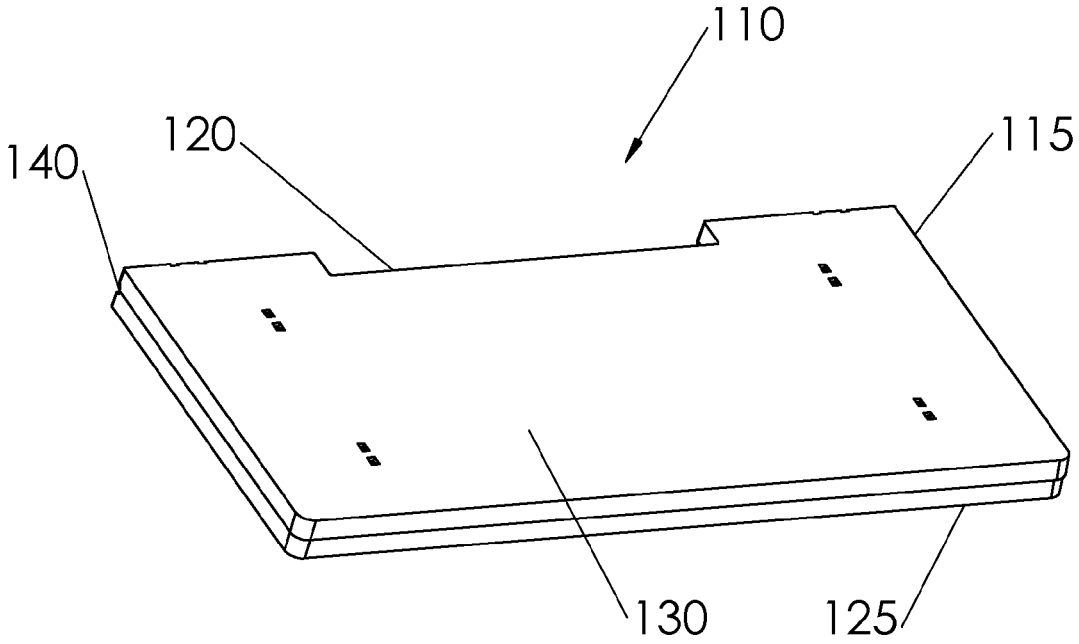
FIG. 4 is a perspective view of a luggage table folded into a compact configuration, according to one embodiment of the present invention.
Figure 5:
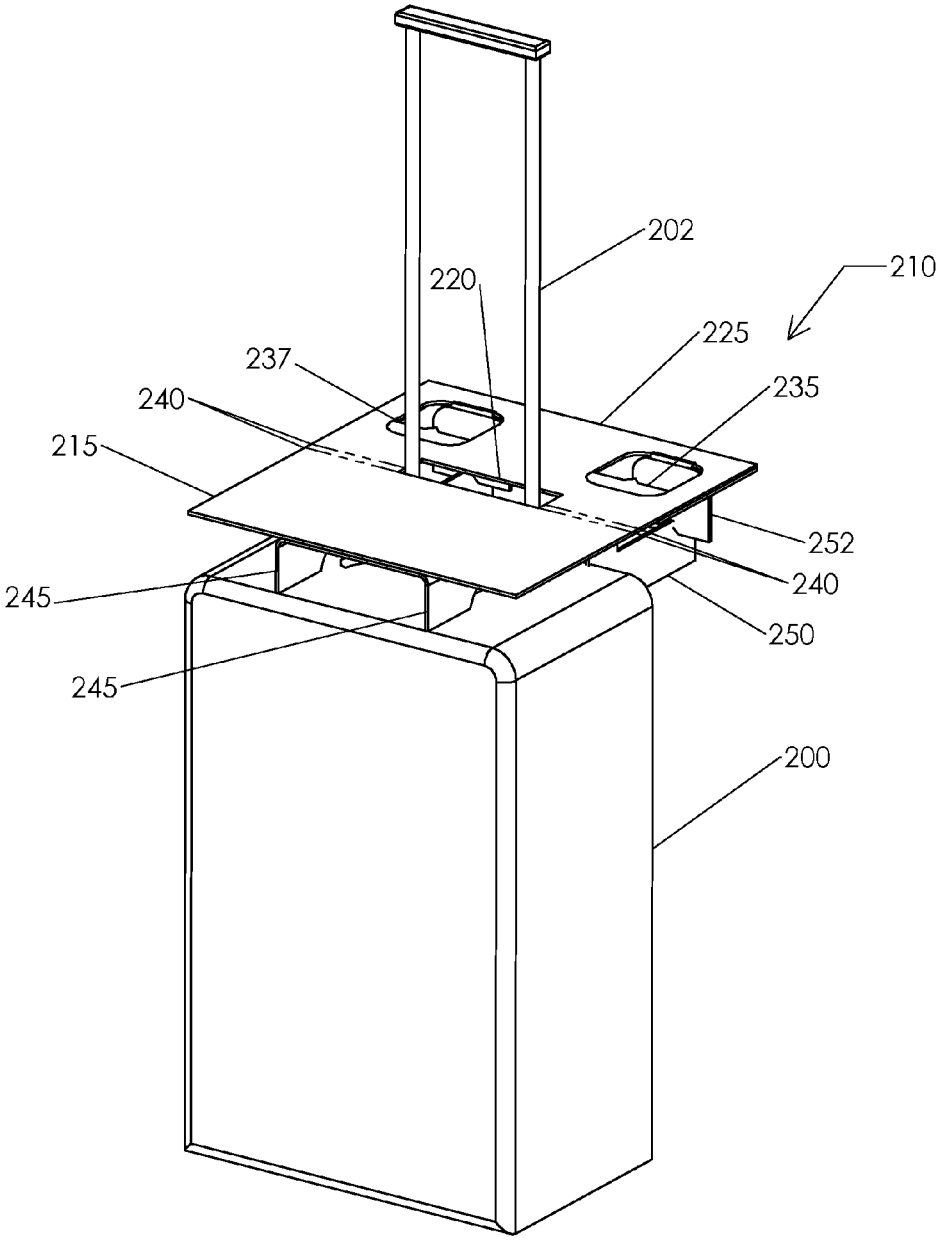
FIG. 5 is a perspective view of a luggage table mounted on a suitcase according to one embodiment of the present invention.
Figure 6:
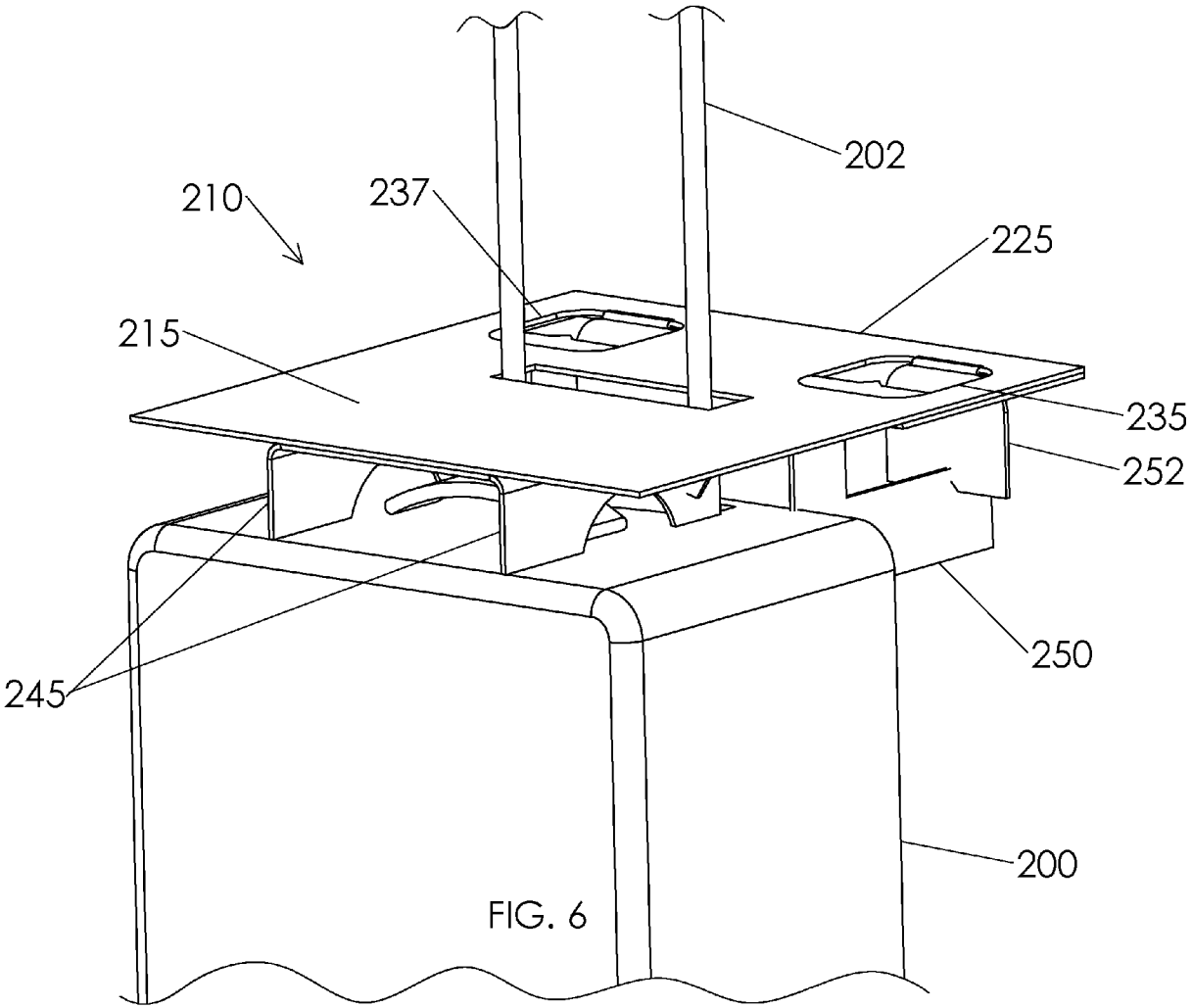
FIG. 6 is a perspective view of a luggage table mounted on a suitcase according to one embodiment of the present invention.
Figure 7:
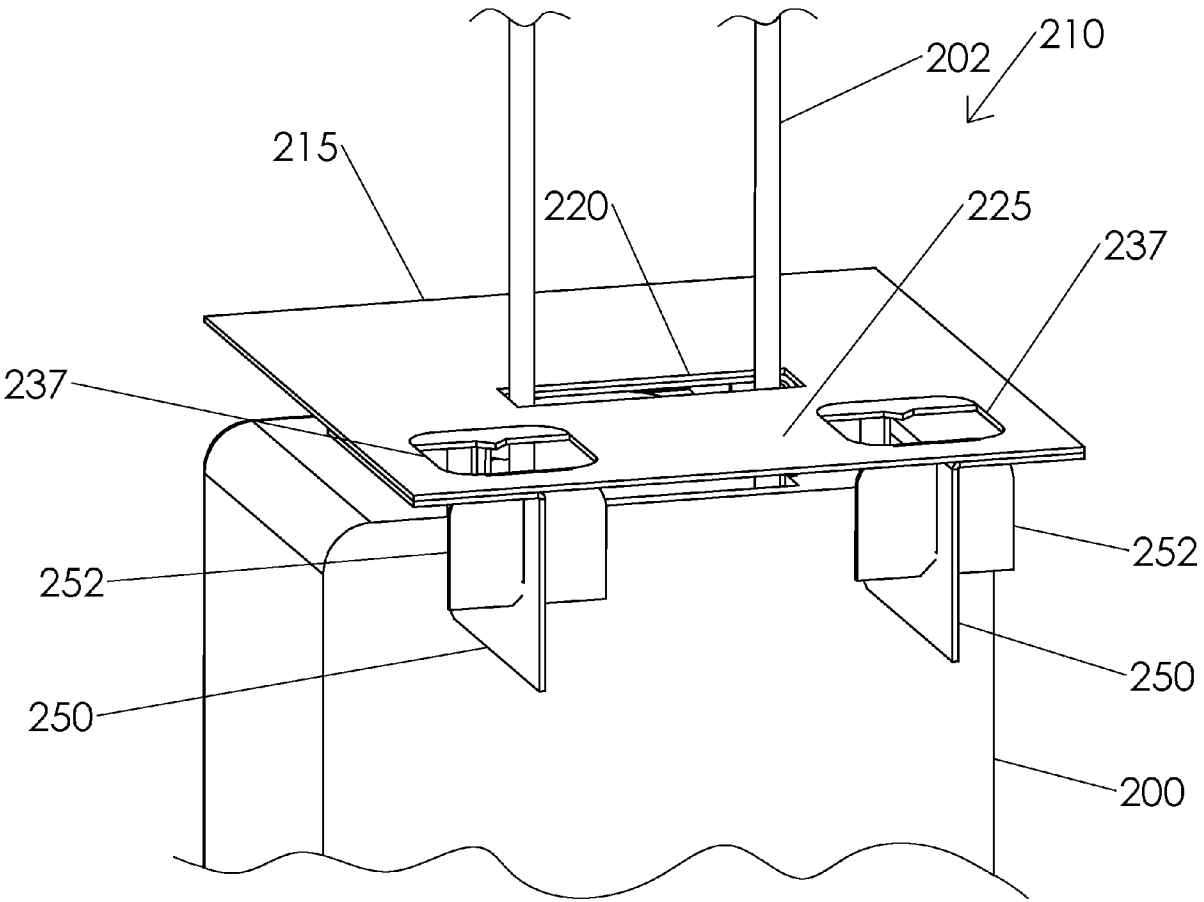
FIG. 7 is a perspective view of a luggage table mounted on a suitcase according to one embodiment of the present invention.
Figure 8:
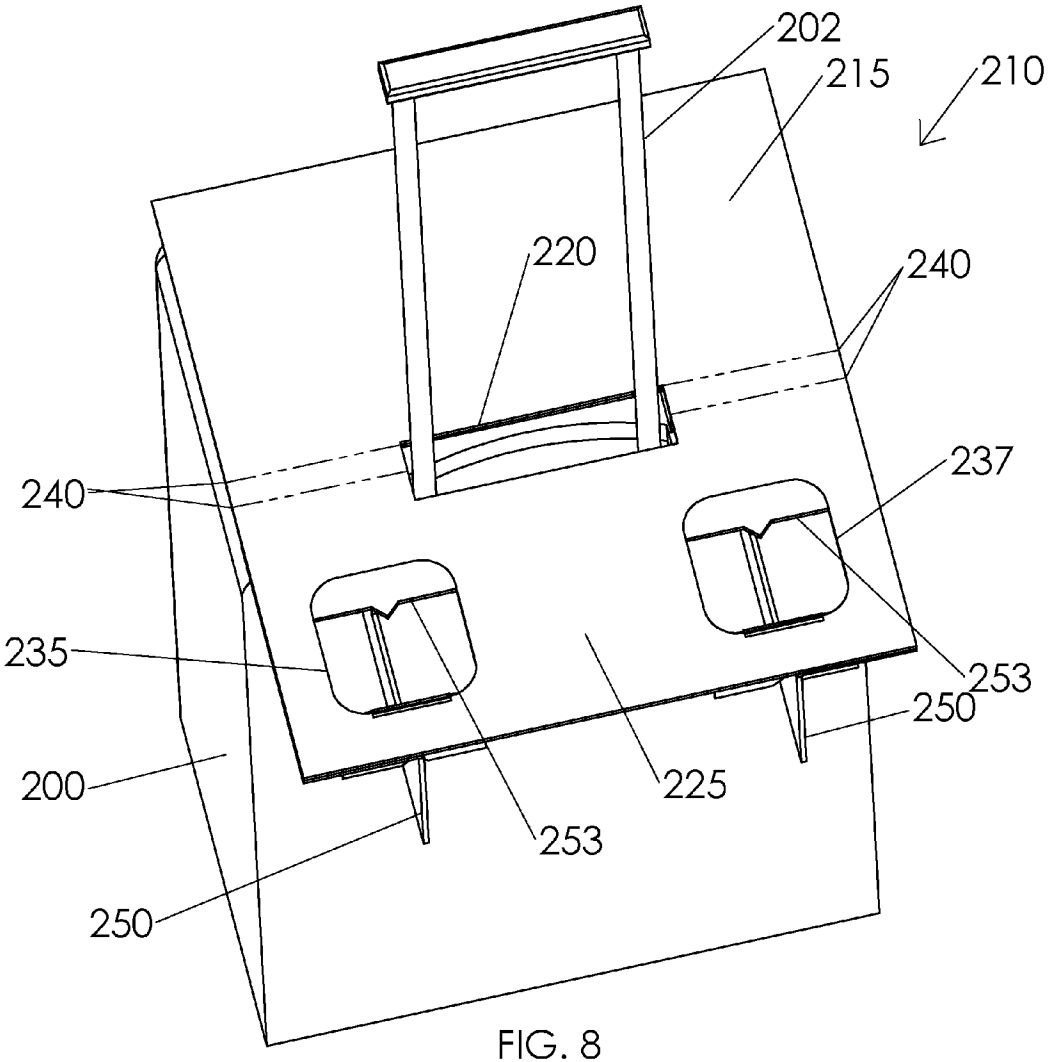
FIG. 8 is a perspective view of a luggage table mounted on a suitcase according to one embodiment of the present invention.

A first embodiment luggage table 110 is illustrated in FIGS. 1-4. The luggage table is illustrated in an open configuration and mounted on a suitcase 100 in FIGS. 1 and 2, with a handle 102 of the suitcase extending through the luggage table. The luggage table is illustrated in an open configuration in FIG. 3 and in a compact configuration in FIG. 4. The suitcase illustrated in FIGS. 1 and 2 is a typical carry-on suitcase with a collapsible/extendable handle 102. The luggage table comprises a platform section 115, a vessel section 125, and a handle aperture 120.

An upwardly facing surface of the platform section 115 is approximately 7.0 inches by 14 inches, and has an area of approximately 98 square inches. Embodiments include an upwardly facing surface having an area that is preferably at least 18 square inches, more preferably between 35 and 225 square inches, and most preferably between 50 and 150 square inches.

The handle aperture 120 of the first embodiment luggage table 110 is approximately 5.875 inches long and 1.5 inches wide. Embodiments include handle apertures that are preferably at least 4.0 inches long and 0.50 inch wide, more preferably at least 5 inches long and 0.75 inch wide, and most preferably at least 5.5 inches long and 1.0 inch wide. The platform section includes a silicone rubber friction pad 130 residing on an upper surface of the platform section. The friction pad 130 has a relatively high coefficient of friction compared to other areas of the luggage table. The friction pad of the first embodiment luggage table comprises silicone rubber covering the entire platform section upper surface. In other embodiments, the friction pad comprises other "grippy" compositions such as, but not limited to, butyl rubber and neoprene. Variations of the friction pad cover only a portion of the platform section. The vessel section 125 can also include a friction pad. In some embodiments, most or all of the vessel section is covered by the friction pad.

Most of the first embodiment luggage table, other than the friction pad, consists essentially of Komatex® (Kommerling® USA, Inc., Huntsville, Ala.) foamed, rigid polyvinyl chloride (PVC). Some embodiments comprise polymers such as, but not limited to, acrylonitrile butadiene styrene (ABS), polyethylene terephthalate (PET), polyetheretherketone (PEEK), polyimide, polycarbonate, polyaniline, acrylate or methacrylate polymers, or fluorinated polymers such as polytetrafluoroethylene or polyfluoroethylenepropylene, and polyolefins such as polyethylene (PE), polypropylene (PP) or polybutylene (PB). Variations include injection molded polymers. Luggage tables comprising other thermoplastics, epoxides, fiber-glass, paper, cardboard, waxed cardboard, corrugated plastic, wood, and composites including carbon fiber composites, are also contemplated. Luggage tables comprising metals or metal alloys can also be used, but are less favored for use in airports.

The vessel section 125 includes a first vessel aperture 135 and a second vessel aperture 137 (not visible in FIG. 1) adapted to receive a vessel. Typically, the vessel apertures are adapted to receive vessels such as, but not limited to, disposable coffee cups or other disposable beverage cups, drinking glasses, or beverage bottles. The vessel apertures can also receive cups for containing sundry items such as pens or pencils, computer "memory sticks," and small cellular phones. The vessel aperture of the first embodiment luggage table is substantially circular and has a diameter of about 3.25 inches. Accordingly, is has an area of about 8.3 square inches. Embodiments include a circular vessel aperture with a diameter as small as 1.875 inches and thus an area of approximately 2.76 square inches.

The luggage table 110 further comprises a hinged junction 140 between the platform section 115 and the vessel section 125. The luggage table is adapted to fold along the hinged junction 140, which enables the luggage table to fold, typically in half, into a compact configuration best illustrated in FIG. 4. In its compact configuration, the luggage table is about 0.5 inch thick, and is adapted to fit into a pocket on the suitcase 100. Embodiments of luggage tables in compact configurations have a maximum thickness that is preferably less than 1.375 inches, more preferably less than 0.75 inch, still more preferably less than 0.5 inch, and most preferably about 0.375 inch. A longest dimension of the first embodiment luggage table in its compact orientation is about 15.7 inches. Embodiments have a longest dimension in a compact configuration that is preferably less than 21 inches, more preferably between 10.9 and 17.9 inches, still more preferably between 13.9 and 17.1 inches, and most preferably about 15.8 inches.

The first embodiment luggage table 110 further comprises support flaps 145 that rest on a top surface of the suitcase 100 to support the platform section directly above the top surface of the suitcase. The luggage table further comprises stabilizer flaps 150 that rest against a side surface of the suitcase, thereby stabilizing the luggage table as the vessel section 125 cantilevers out away from the suitcase. The top surface and the side surface reside in planes that are about perpendicular to each other. The top surface is about horizontal and the side surface is about vertical when the suitcase is oriented about upright, as shown in FIGS. 1 and 2. The support flaps and the stabilizer flaps fold flat against undersides of the platform section and the vessel section, respectively, in order to facilitate folding of the luggage table into the compact configuration.

As shown in FIGS. 1 and 2, an electronic device 155 such as an iPad® or Kindle® is disposed on the luggage table 110, the electronic device leaning against the suitcase handle 102 with its bottom end residing on the friction pad 130. So disposed, the electronic device is well suited for use, its screen being readily readable while the suitcase 100 is in an upright position and the friction pad impeding the bottom end of electronic device from sliding off the platform section 115.

As best shown in FIG. 2, a vessel receptacle 136 comprises a void or gap in the stability flap 150, and resides below the first vessel aperture 135. The vessel receptacle is adapted to receive and hold a vessel bottom, thereby preventing the vessel from dropping completely thought the vessel aperture 135. The vessel receptacle is not shown in FIGS. 1 and 4. In some embodiments, vessel receptacles comprise flexible mesh, fabric, or other supple material, allowing the receptacles to fold, crumple, or otherwise yield to enable the luggage table to fold into its compact configuration. The vessel receptacle together with the vessel aperture can be referred to as a vessel holder.

In the first embodiment, the platform section is about 7 inches by 14 inches and the vessel section is also about 7 inches by 14 inches. Accordingly, in its open configuration, the luggage table is about 14 inches by 14 inches. In its compact configuration, best illustrated in FIG. 4, the luggage table is about 7 inches by 14 inches by about 0.5 inch thick, and is thus adapted to be received into a relatively small pocket in the suitcase.

A Second Embodiment Luggage Table

A second embodiment luggage table 210 is illustrated in FIGS. 5-11. The luggage table is illustrated in an open configuration in FIGS. 5-8, mounted on a suitcase 200 with a handle 202 of the suitcase extending through the luggage table. The suitcase illustrated in FIGS. 5-8 is a typical rolling, carry-on suitcase with a collapsible/extendable handle 202. The luggage table comprises a platform section 215, a vessel section 225, and a handle aperture 220. The platform section of the second embodiment, which constitutes approximately ½ of the top surface of the luggage table, has a rectangular upper surface having sides of approximately 7.25 inches and approximately 14 inches. A perimeter of an upper surface of the vessel section is also substantially rectangular, having sides of approximately 7.25 inches and approximately 14 inches. The second embodiment luggage table consists essentially of corrugated cardboard and is relatively lightweight, weighing approximately 128 grams. Embodiments of luggage tables preferably weigh less than 500 grams, more preferably less than 375 grams, still more preferably less than 250 grams, and most preferably less than 150 grams. Less weight is typically, but not necessarily, an advantage, resulting in a luggage table that is easier to carry and store, and also a less top-heavy combination when installed on luggage.

The vessel section 225 includes a first vessel aperture 235 and a second vessel aperture 237, each adapted to receive a vessel such as, but not limited to, disposable coffee cups or other disposable beverage cups, drinking glasses, or beverage bottles.

The luggage table 210 further comprises a hinged junction 240 disposed between the platform section 215 and the vessel section 225. The hinged junction of the second embodiment comprises multiple slits oriented along two parallel lines, which facilitates bending the corrugated cardboard along the lines. The luggage table is adapted to fold along the hinged junction 240, which enables the luggage table to fold, typically in half, into a compact configuration. In its compact configuration, the luggage table is relatively flat, forming a rectangular cube having perpendicular sides of approximately 7.25 inches and 14 inches, and a maximum thickness of approximately 0.375 inch. The 0.375 inch thickness is facilitated by the multiple slits of the hinged junction being oriented along two parallel lines separated by approximately 0.375 inch. When in the compact configuration, the luggage table is adapted to readily fit into an external pocket on the suitcase 200.

The second embodiment luggage table 210 further comprises support flaps 245 that extend downwardly from the platform section 215 and approximately perpendicular thereto. The support flaps typically rest on the suitcase 200 to support the luggage table. The luggage table further comprises stabilizer flaps 250 that extend downwardly from the vessel section 225, approximately perpendicular thereto. As best shown in FIGS. 5-8, the platform 210 section is supported from directly underneath by the suitcase, and the vessel section 225 cantilevers out from the platform section, unsupported from directly underneath by the suitcase. The stabilizer flaps rest against a substantially vertical side of the suitcase to stabilize the luggage table, particularly the vessel section, in its cantilevered position.

Figure 9:
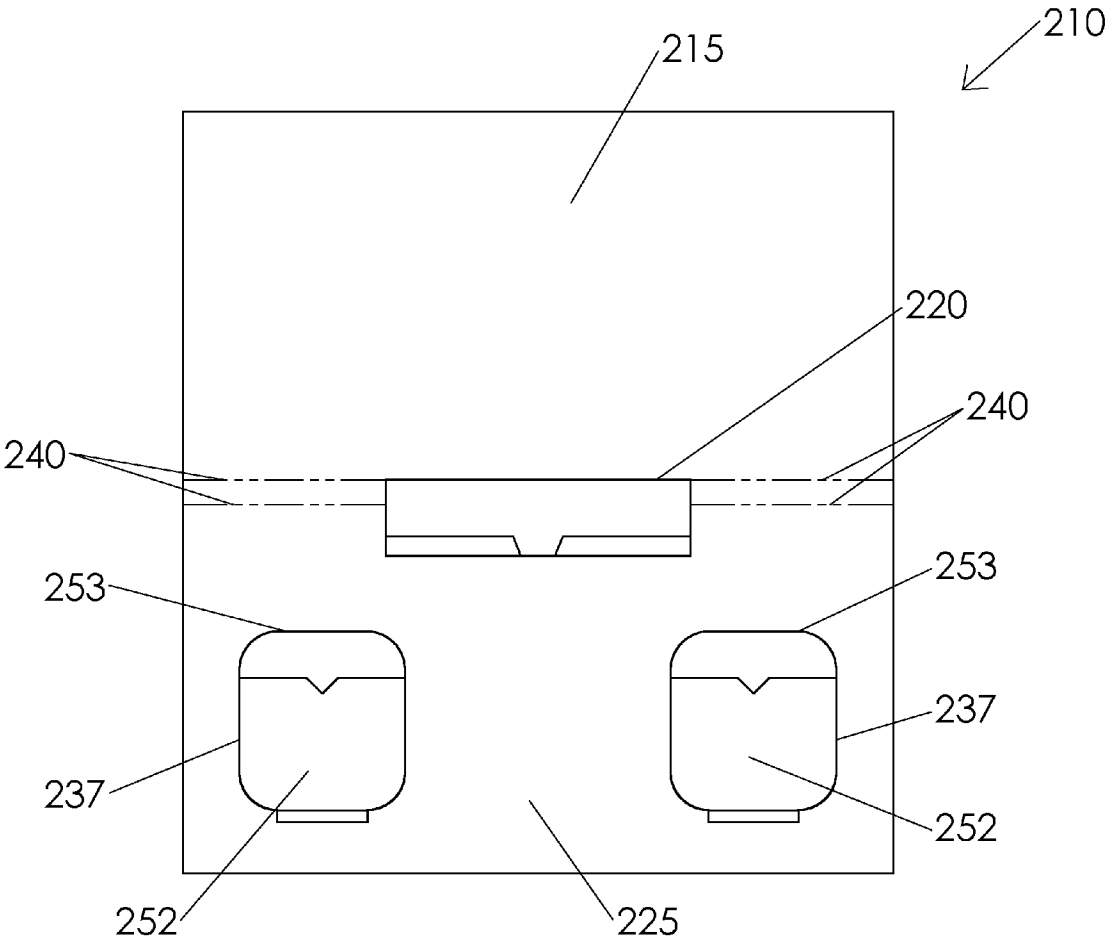
FIG. 9 is a top, plan view of a top side of a luggage table in a flat configuration according to one embodiment of the present invention.
Figure 10:
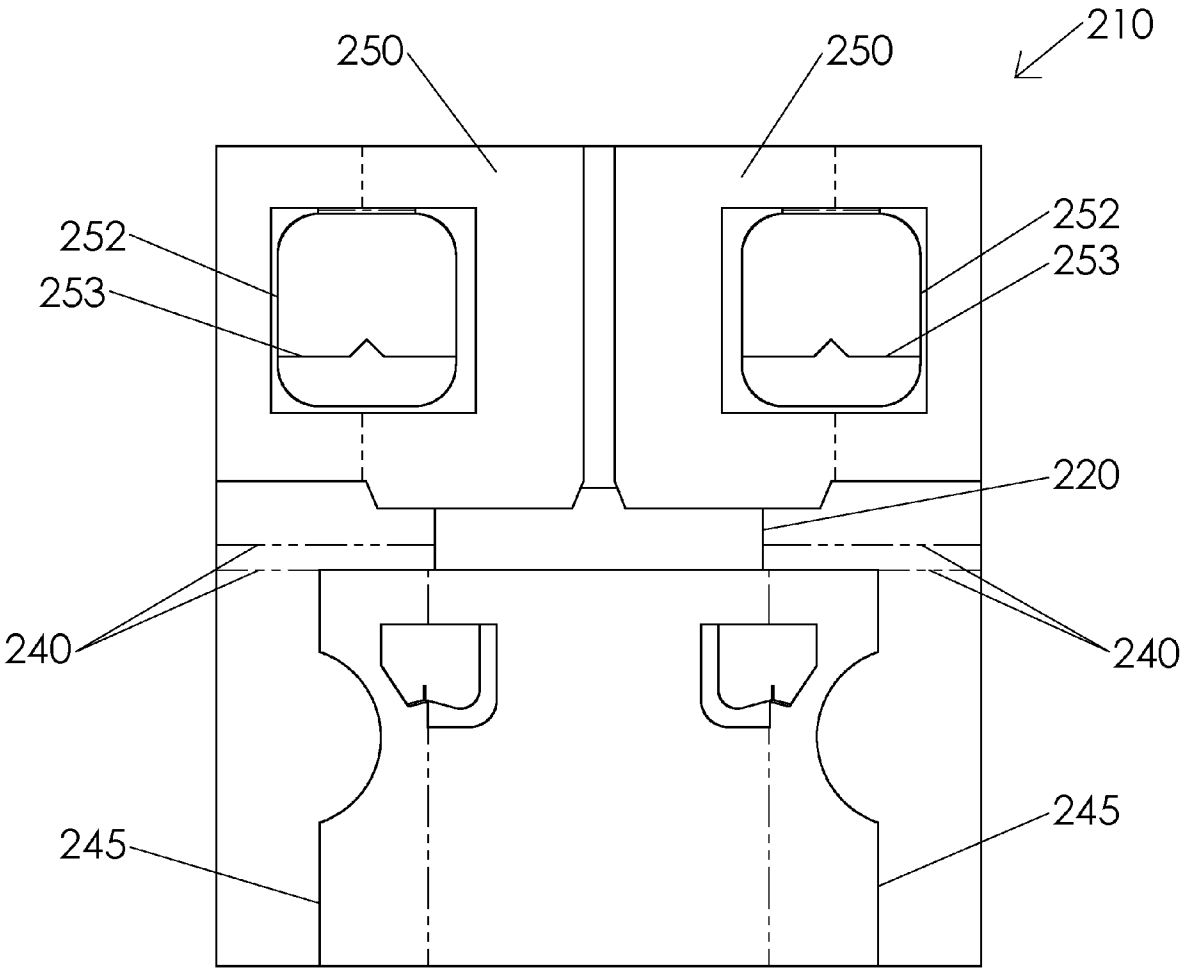
FIG. 10 is a bottom, plan view of a bottom side of a luggage table in a flat configuration according to one embodiment of the present invention.

As best seen in FIGS. 9 and 10, the support flaps 245 and the stabilizer flaps 250 are adapted to reside flat against undersides of the platform section 215 and the vessel section 225, respectively, in order to facilitate folding the luggage table into the compact configuration. The stabilizer flaps 250 also act as vessel support members because they are adapted to support a vessel residing in the vessel apertures 235, 237.

Figure 11:
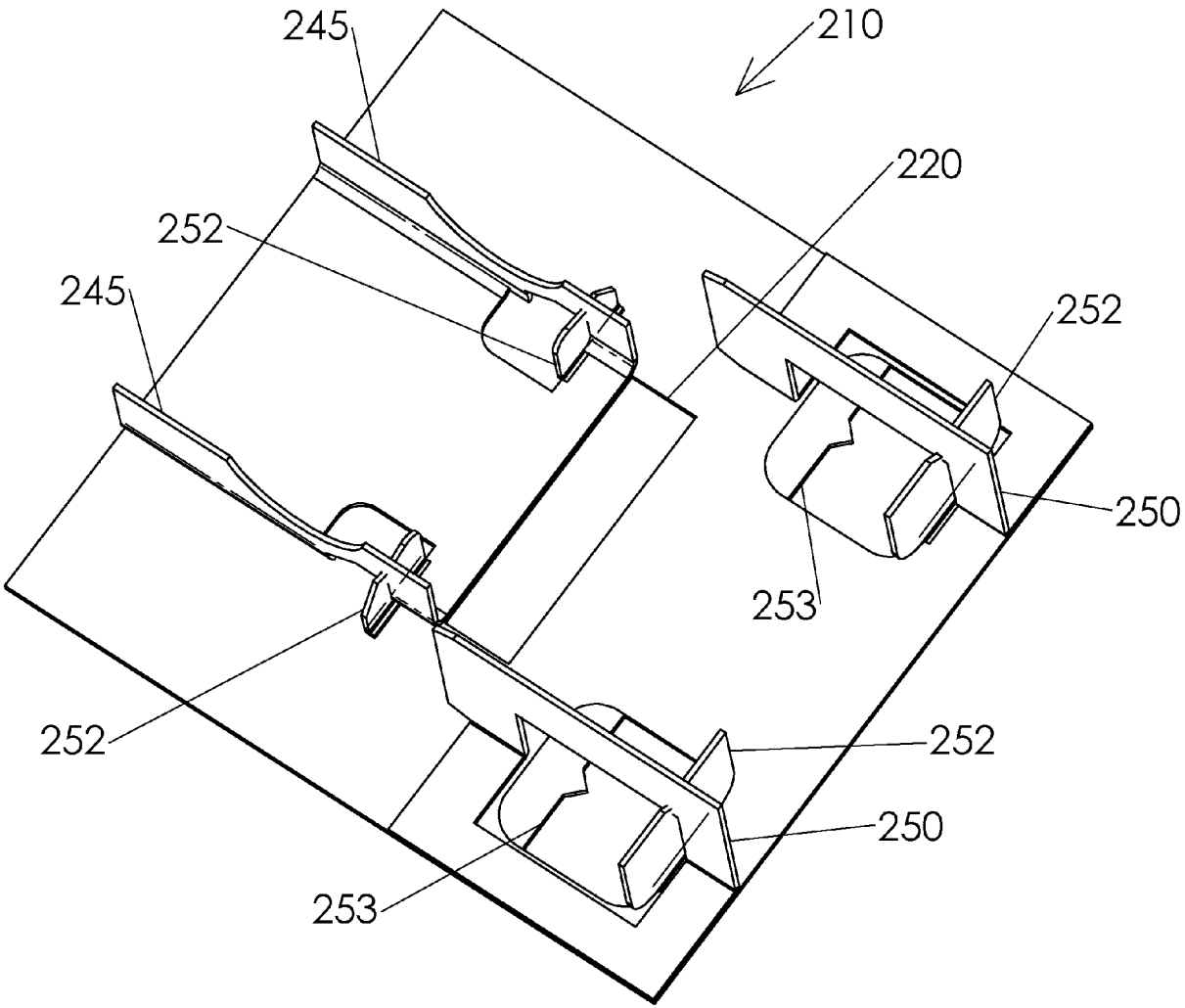
FIG. 11 is a perspective, bottom view of a luggage table in a deployed configuration according to one embodiment of the present invention.

The second embodiment luggage table 210 is shown in FIGS. 9-11 in the absence of luggage. FIG. 9 illustrates the luggage table lying flat and right side up, with the support flaps 245 and stabilizer flaps 250, neither of which are visible in FIG. 9, being folded against undersides of the platform section 215 and the vessel section 225, respectively. The luggage table further comprises anchoring flaps 252. As best seen in FIG. 11, the anchoring flaps 252 are adapted to engage the stabilizer flaps 250 when both anchoring and stabilizing flaps are deployed, thus reversibly securing the stabilizer flaps in a deployed configuration. The support flaps 245, stabilizing flaps 250, and anchoring flaps 252 are in flat configurations as the luggage table is illustrated in FIGS. 9 and 10, and deployed configurations as the luggage table is illustrated in FIGS. 5-8 and 11.

The second embodiment luggage table 210 further comprises vessel pressure flaps 253 adapted to press against a vessel residing in the first vessel aperture 235 or the second vessel aperture 237, thereby stabilizing the vessel in its aperture. So stabilized, the vessel is less likely to move about within the vessel aperture.

The vessel apertures 235, 237 are about 3.25 by 2.625 inches, resulting in an area of about 8.53 square inches. However, the vessel pressure flaps 253 are adapted to flex, resulting in a larger vessel aperture. With their pressure flaps fully flexed, each of the vessel apertures of the second embodiment are about 3.25 by 3.5 inches, thus having an area of about 11.4 square inches. Variations of individual vessel apertures have areas preferably greater than 2.5 square inches, more preferably between 4.5 and 20 square inches, and most preferably between 6.0 and 12.25 square inches.

In some embodiments, the luggage table comprises waxed cardboard, or cardboard that has a treated surface that changes physical properties of the cardboard. For instance, the cardboard can be treated with compositions such as, but not limited to, silicone rubber, butyl rubber, and neoprene, to create an area having a greater coefficient of friction compared to untreated areas of the luggage table. Some embodiments are treated with a composition, such as, but not limited to, silicone, wax, or polyurethane, to increase water resistance of the cardboard. Embodiments of the luggage table include graphics or indicia printed thereupon for purposes such as, but not limited to, decoration, advertizing, or to convey instructions or other information. In some embodiments, a map of an airport is printed on the luggage table. The relatively low cost of luggage table embodiments made of cardboard make such a luggage table well suited for giving the item away for promotional purposes. Such promotional giveaway items can be referred to as "swag." The cardboard embodiments are relatively inexpensive and may thus be considered disposable.

A Method of Using a Luggage Table

A method of using a luggage table comprises a first operation including orienting the second embodiment luggage table in an open configuration and installing the luggage table on a rolling, carry-on suitcase familiar to air travelers. The suitcase is sitting upright with its extendable handle extending upwardly from a top surface of the suitcase, the top surface being about horizontal. The support flaps of the installed suitcase rest on the top surface of the suitcase, with the platform section residing directly above the top surface and the extendable handle projecting through the handle aperture. The vessel section cantilevers out from the platform section, with the stabilizing flaps pressing against a side surface of the suitcase, the side surface being about vertical.

A second operation comprises placing a tablet computer, electronic reader, smart phone, laptop computer, or similar device on the platform section. The second operation further comprises placing a beverage vessel in a vessel aperture. The beverage vessel is typically, but not necessarily, a coffee cup containing coffee or a soft drink cup. In some methods of using a luggage table, a food item or book is placed on the platform section.

A third operation comprises rolling the suitcase to a different location while the beverage vessel remains in the vessel aperture.

A third operation comprises removing the tablet computer or other device from the platform section, removing the coffee cup from the vessel aperture, and removing the luggage table from the suitcase.

A fourth operation comprises folding the luggage table into a compact configuration, placing the luggage table into an outside pocket of the suitcase, and zipping the outside pocket closed.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

In some embodiments, the luggage table is part of a carry-on suitcase or other luggage. Variations include a luggage table in which the platform section and the vessel section detach from each other, and each of the platform section and vessel section stow into their own pockets in the suitcase.

We claim:

1. A luggage table comprising:

a platform section including (i) an upwardly oriented platform surface having an area of at least 18 square inches, (ii) a platform underside and (iii) at least a pair of support flaps, each support flap being pivotally coupled to the platform underside movable between a first position substantially projecting away from the platform underside and a second position substantially lying flat against the underside, each support flap having a vertical height when in the first position;

a vessel section, the vessel section and the platform section meeting at a hinged junction, the vessel section including (i) a vessel aperture, (ii) an upwardly orientated vessel surface, (iii) a vessel underside and (iv) at least one stability flap pivotally coupled to the vessel underside along a line substantially orthogonal to a longitudinal direction of the hinged junction movable between a first position substantially projecting away from the platform underside and a second position substantially lying flat against the vessel underside, the stability flap including a linear edge closest to the hinged junction that is generally vertically-orientated when the stability flap is in the first position and having a vertical height when in the first position, the at least one stability flap further defines a vessel receptacle underneath the vessel aperture when in the first position, the vessel receptacle is configured to hold and receive a vessel bottom when the vessel is received through the vessel aperture; and a handle aperture, the handle aperture located at the hinged junction with a portion of the handle aperture being located in the platform section and another portion of the handle aperture being located in the vessel section, the handle aperture being adapted to receive a suitcase handle therethrough;

wherein the vertical height of the support flaps is substantially less than the vertical height of the stability flap when each are in the first position.

2. The luggage table of claim 1, wherein the luggage table is adapted to reside in either of an open configuration or a compact configuration, the open configuration having a longest dimension greater than 18 inches and the compact configuration (i) having a longest dimension of between 10.9 inches and 17.1 inches and (ii) having a maximum thickness of less than 1.375 inches.

3. The luggage table of claim 1, wherein the luggage table is adapted adjust from an open configuration into a compact configuration by folding about the hinged junction, the compact configuration having a maximum thickness less than 1.375 inches and a longest dimension between 6 inches and 21 inches.

4. The luggage table of claim 1, wherein the luggage table weights less than 150 grams.

5. The luggage table of claim 1, wherein the linear edge is configured to rest against a vertical side of a suitcase when received over and on the suitcase in a deployed configuration with the stability flap in the first position.

6. The luggage table of claim 1, wherein the handle aperture is rectangular.

* * * * *